United States Patent [19]

Naylor

[11] 4,180,397

[45] Dec. 25, 1979

[54] MACHINABLE STEEL

[75] Inventor: David Naylor, Rotherham, England

[73] Assignee: British Steel Corporation, London, England

[21] Appl. No.: 941,600

[22] Filed: Sep. 12, 1978

[30] Foreign Application Priority Data

Sep. 15, 1977 [GB] United Kingdom ..... 38550/77

[51] Int. Cl.[2] ..... C21C 7/02

[52] U.S. Cl. ..... 75/58; 75/53

[58] Field of Search ..... 75/58, 53

[56] References Cited

U.S. PATENT DOCUMENTS

| | | | |
|---|---|---|---|
| 3,980,469 | 9/1976 | Forster | 75/58 |
| 3,992,195 | 11/1976 | Klapdar | 75/58 |
| 3,998,625 | 12/1976 | Koros | 75/58 |
| 4,004,922 | 5/1977 | Thivellier | 75/123 G |
| 4,066,444 | 3/1978 | Kosmider | 75/58 |
| 4,076,522 | 2/1978 | Yoshida | 75/58 |
| 4,083,716 | 4/1978 | Yoshida | 75/58 |
| 4,121,923 | 10/1978 | Gruner | 75/58 |

FOREIGN PATENT DOCUMENTS

| | | | |
|---|---|---|---|
| 1450013 | 9/1976 | United Kingdom | 75/58 |
| 1476182 | 6/1977 | United Kingdom | 75/58 |
| 1478218 | 6/1977 | United Kingdom | 75/58 |
| 1479222 | 7/1977 | United Kingdom | 75/58 |

*Primary Examiner*—P. D. Rosenberg

*Attorney, Agent, or Firm*—Bacon & Thomas

[57] ABSTRACT

Production of resulphurized steel with enhanced machinability having a sulphur content of between 0.05 and 0.20% by weight, in which an alkali earth metal having a high affinity for sulphur (eg. Calcium or Calcium bearing alloys) are added to a steel melt in sufficient quantity to provide in the steel when solidified, isolated globular sulphide inclusions. Calcium additions of between 0.02 and 0.20% by weight are proposed.

8 Claims, 3 Drawing Figures

CAST B.

CAST C.

MACHINABLE STEEL

This invention relates to the production of resulphurized steels.

The use of an alkali earth metal additive (such as calcium) as a deoxidizer, desulphurizer and inclusion modifier in a wide range of steels has been stimulated in recent years by the need to produce improvements in ductility, toughness, fatigue properties and machinability. Such additives have previously been used for certain specialised steel-making applications, principally to modify oxide inclusions in carbon and alloy steels in order to improve fatigue properties and to modify inclusions in order to improve machinability. More recently, calcium has been used as a desulphurizer in the manufacture of steels where ductility requirements dictate final sulphur levels less than 0.008 wt %.

In certain medium carbon and alloy steels some hot forged components are subjected to machining operations such as turning, milling and drilling. In these steels machinability can be improved substantially by the addition of sulphur. However, the sulphide particles responsible for improved machinability may, if not properly controlled, produce adverse changes in toughness or fatigue properties of the finished component.

The present invention sets out to minimise the adverse effects of sulphides on mechanical properties in steels with enhanced sulphur levels and to enhance the machinability of such steels by the addition of alkali earth metals which have a high affinity for sulphur.

According to the present invention there is provided a method of producing a resulphurised steel having a sulphur content of between 0.05% and 0.20% by weight which comprises forming a melt of the steel and adding to the melt an alkali earth metal having a high affinity for sulphur in sufficient quantity to provide in the steel when solidified isolated, globular sulphide inclusions.

In one preferred method, the sulphur content of the steel lies in the range 0.08 to 0.15% by weight. In a second preferred method, the sulphur content lies in the range 0.08 to 0.12% by weight.

The alkali earth metal may comprise calcium or calcium-bearing alloys. Additions of calcium preferably lie within the range of 0.02 and 0.20% by weight. In one preferred method, the calcium addition lies in the range 0.02 to 0.067% by weight. In a second preferred method, the calcium addition lies in the range 0.05 and 0.10% by weight.

The alkali earth metal may be injected into the molten steel through the bore of a hollow lance submerged in the melt. Alternatively, the addition may be encapsulated and either thrown or plunged into the ladle containing the melt during teeming.

Any desulphurisation occuring from the alkali earth addition is compensated for by the initial sulphur content of the steel prior to the addition being made in order to achieve in the steel product a sulphur level within the required range.

The invention will now be described with reference to the following examples and accompanying drawings in which.

EXAMPLE 1

Several 50 kg ingots of SAE 8620 type steel were cast into metal moulds. The ingots were made in three distinct series, casts with a sulphur content within the SAE 8620 steel specification, casts with a sulphur content above the SAE 8620 steel specification and a cast again with a high sulphur content to which had been added calcium silicide in an amount equivalent to 0.15% by weight. The analyses for these three casts, respectively called A B C and of the standard SAE 8620 steel specification are shown in the following Table 1.

Table 1

| | ANALYSIS WT % | | | | | | | |
|---|---|---|---|---|---|---|---|---|
| Sample | C | Si | Mn | P | S | Cr | Mo | n |
| SAE 8620 Steel Specification | 0.18/0.23 | 0.2/0.35 | 0.7/0.9 | 0.035 max | 0.040 max | 0.4/0.6 | 0.15/0.25 | 0.4/0.7 |
| A | 0.19 | 0.23 | 0.75 | 0.019 | 0.021 | 0.50 | 0.15 | 0.58 |
| B | 0.21 | 0.32 | 1.10 | 0.042 | 0.120 | 0.53 | 0.18 | 0.53 |
| C | 0.17 | 0.37 | 1.13 | 0.012 | 0.096 | 0.59 | 0.18 | 0.48 |

In producing casts B and C an effort was made to maintain hardenability by achieving a constant residual manganese content of 0.80% using the relationship total Manganese content=0.80+55/32% S The ingots were forged to 65 mm diameter test bars and normalised from 925° C. for machinability testing. Material from the cast was forged to 6" by 1" plate section and oil quenched from 920° C. for mechanical property studies. All samples were rough machined to remove surface defects prior to machinability testing.

Figure 1:
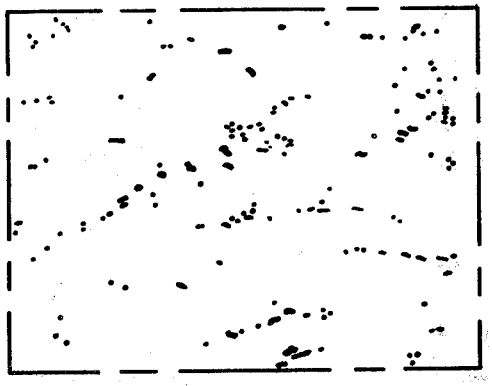
FIG. 1 illustrates unetched micro-structures of a resulphurized steel bar in accordance with the invention when compared with one to which no alkali earth metal addition has been made.
Figure 1:
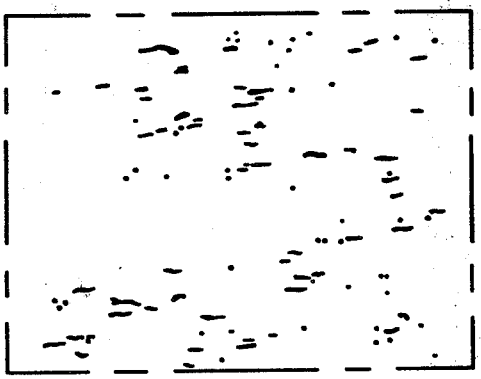

FIG. 1 illustrates unetched micro-structures of casts B and C. Type II eutectic sulphide inclusions are evident in cast B. More oval inclusions have been produced as a result of the calcium silicide addition in Cast C. 'Birds eye' Duplex inclusions were present in the treated cast compared to alumina particles in the non-treated cast. The normalised structures exhibited ferrite, pearlite, and bainite. The hardness values of the casts were in the range 170 to 200 $H_v30$.

Figure 2:
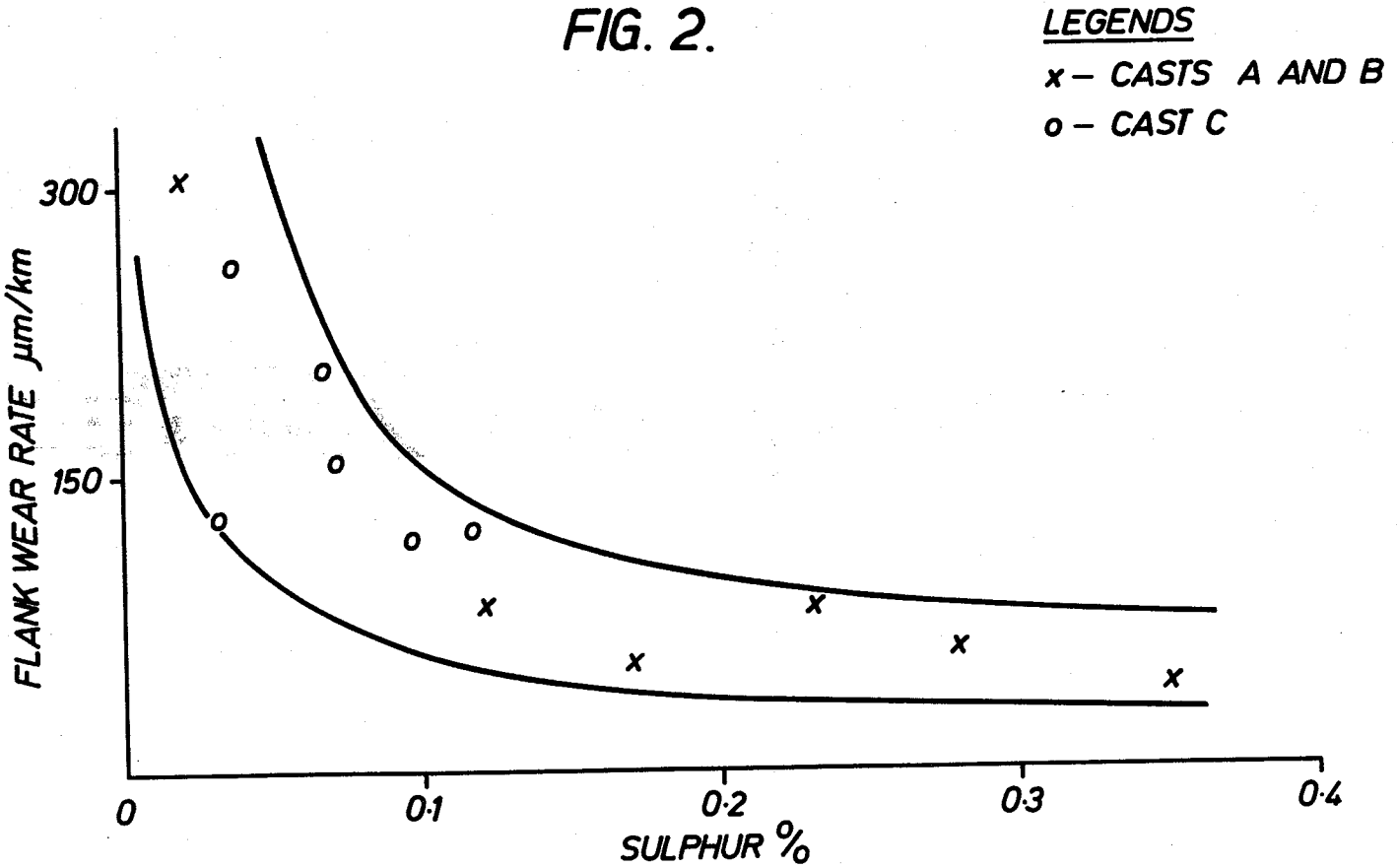
FIG. 2 is a graph which illustrates the effect of sulphur content on flank wear rate of SAE 8620 steels.

Tool wear tests were carried out without lubrication using 150 P30 grade cemented carbide cutting tools. Flank wear was recorded at intervals of 2 minutes and the wear rates calculated from the linear region of the flank where curves are shown in FIG. 2 related to the sulphur content of the three casts. The degree of scatter in machinability reduced as the sulphur content was raised above 0.07%. During the tool wear tests the chip form produced on casts B and C was superior to that of cast A. In particular, small easily disposable chips were produced on the samples from cast C.

Figure 3:
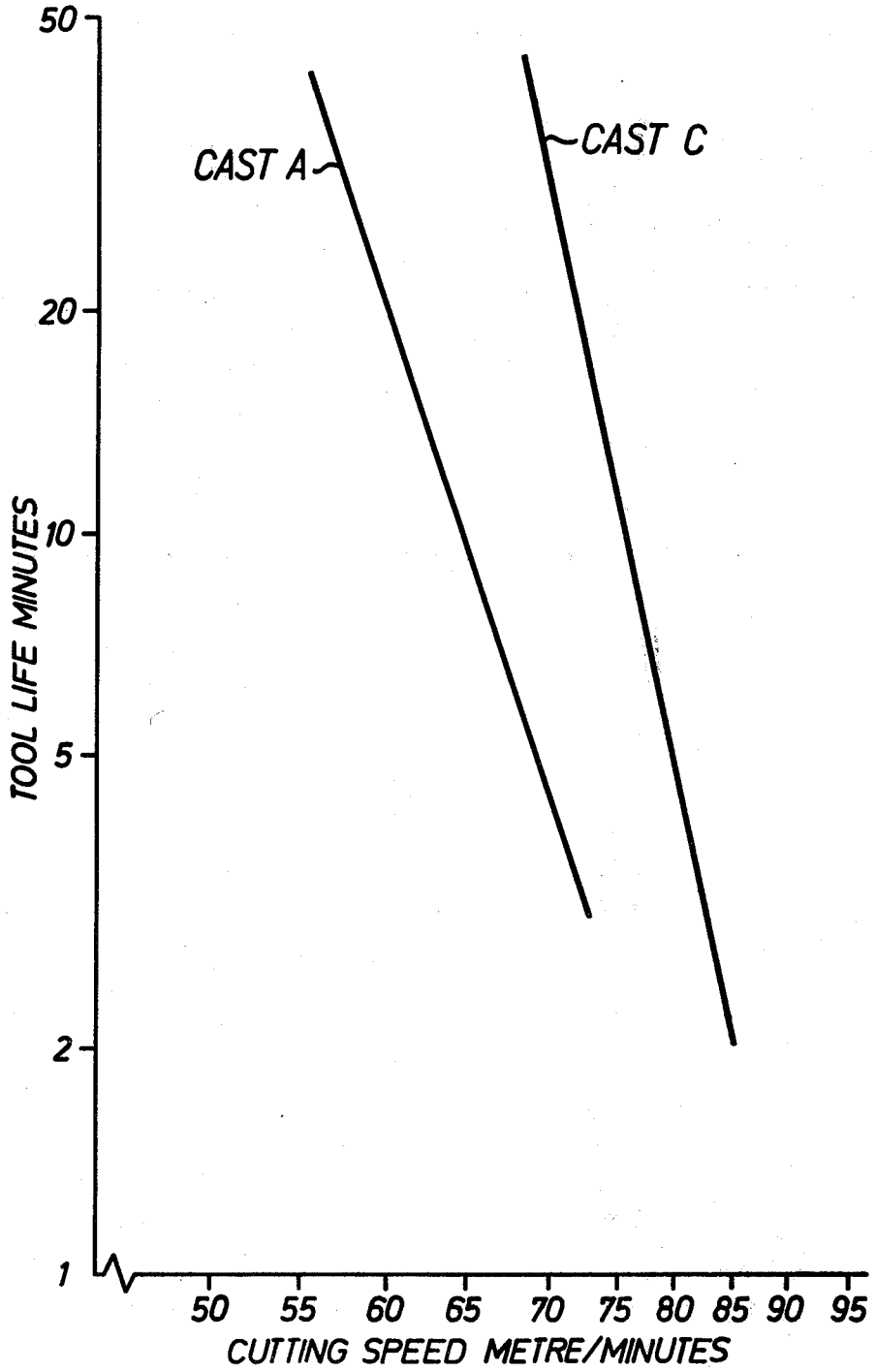
FIG. 3 is a graph showing tool life curves for SAE 8620 steel.

High speed steel tool life tests were also performed on samples of casts A and C. The time to catastrophic tool failure of A1S1 T5 high speed steel cutting tools were recorded at several cutting speeds and the results quoted on logarithmic axis in FIG. 3. The values of V20, the cutting speed required to give a tool life of 20 minutes, were 18% higher on the samples from cast C than on low sulphur steel made to a commercial composition.

Tensile, impact and rotating bending fatigue tests were carried out on samples from cast C. The samples were machined from forged and oil quenched material. The results of these tests are shown in Table 2 below. The overall effect of the alkali earth addition was to maintain properties within specification.

Table 2

| Treatment | BSC 970 equivalent 805 M17 | | 0.09% S + additive | |
|---|---|---|---|---|
| Testing Directions | Longitudinal | Transverse | Longitudinal | Transverse |
| Tensile strength $N/mm^2$ | 770 | — | 776 | 778 |
| Elongation % | 12.0 | — | 23.7 | 21.0 |
| Reduction of area, % | 55.0 (typical) | — | 50.0 | 30.7 |
| Izod (average) ft lb | 20 | — | 33.5 | 24.0 |
| Charpy (average) Joules | 52 (typical) | — | 47.2 | 29.5 |
| Fatique Limit N/mm | 365 (typical) | — | 405 | 405 |

The degree of scatter in machining performance of steel from casts with the enhanced sulphur content was also reduced because of the increased sulphur content.

As mentioned above improvements in machinability as assessed by the tool life test technique were also realised for steels from cast C. No significant effect of tensile properties due to the increased sulphur content occurred although impact values were slightly lower in the steel samples from cast C. However, due to the modification inclusion morphology by calcium addition this reduction was not sufficient to reduce the values below the minimum Izod requirements for the steel grade. Although, elongation and reduction of area were all lower in the transverse than in the longitudinal direction even lower transverse properties would have been obtained with the calcium treatment. The tensile strength and fatigue limits were similar in the transverse direction to those in the longitudinal direction and a higher limit was achieved in the treated cast.

From the results achieved in this Example it would be seen than an improved machinable SAE 8620 steel can be produced by increasing the sulphur content to around 0.10% by weight and by the addition of calcium silicide. This improvement can be achieved without serious detriment to tensile properties and with improvements to fatigue limit and bending fatigue resistance.

EXAMPLE 2

A cast of resulphurized steel of the XC38 type was produced. In the molten state an addition of calcium of the order of between 0.02 and 0.35% by weight was made. The chemical analyses of this cast together with a cast of non-resulphurized XC38 type steel without calcium addition are given in Table 3 below. These two casts are respectively identified as casts D and E in the Table.

Table 3

| Cast | C | Si | Mn | P | S |
|---|---|---|---|---|---|
| XC38 Specification | 0.35/ 0.41 | 0.40 Max | 0.70/ 1.00 | 0.03 Max | 0.021 0.04 |
| D | 0.33 | 0.31 | 1.10 | 0.01 | 0.077 |
| E | 0.35 | 0.27 | 0.76 | 0.014 | 0.030 |

The resulphurized steel with calcium addition was cast into a sand mould to simulate the cooling rate of a commercial ingot. The ingot formed was forged to test bars for machinability testing and mechanical property evaluation. The bars for machinability testing were heat treated at a temperature of 850° C. for 30 minutes followed by water quenching and then tempered for 60 minutes at 620° C.

Material from cast E was found to contain small filamental sulphides, whereas the material from cast D had improved sulphide morphology with the oxide inclusions contained within sulphide envelopes. The heat treated bars from cast D exhibited a bainitic structure at the surface of the bar which changed to ferrite, pearlite and bainite nearer the centre. Consequently the hardness varied throughout the section but was within the range 205 to 228 $H_v30$. The samples from cast E had a tempered ferrite and pearlite structure reflecting the lower manganese content than that of cast D. The hardness of the sample from the cast E was 207 $H_v30$.

A machinability assessment based on single point turning was carried out on bar samples from both casts. The results of this assessment are shown in Table 4 below.

Table 4

| Cast No. | Condition | Specn. | FWR μm/km | CDWR μm/km | Surface Finish μm | V20 m/min | HV30 |
|---|---|---|---|---|---|---|---|
| D | Q + T | Resulph. XC38 | 25.3 | Nil | 3.5 | 215 | |
| E | Q + T | XC38 | 168.7 | | 4.2 | 207 | |

It was found from this assessment that the carbide flank wear rate of samples from cast D was substantially below that of samples from cast E. The wear rates for the cast D samples were within the range 14.3 to 25.3 μm/km compared with 168.7 μm/km for cast E. Crater wear was negligible for samples from cast D. Chip form was also good when cutting samples from cast D, whereas the chips from cast E were troublesome and a chip breaker had to be employed. The results of tool life tests showed that machinability of the quenched and tempered samples from cast D were 24.2% better than samples from cast E in terms of V20 values.

So far as mechanical properties are concerned it was found that samples from cast D satisfied the required specification for longitudinal tensile and impact properties. The mechanical properties of samples from cast D are set out in the following Table.

Table 5

| Cast No. | Direction | Tensile Properties UTS kgf/mm² | YP kgf/mm² % | El R of A % | Impact kgm/cm² |
|---|---|---|---|---|---|
| D | Longit | 99.4 | 91.2 | 17.55 | 7.6,8.0,7.8 |
| Specification | | 85–105 | 62 min–10 min | | 6 min |

To summarise therefore the Example showed that the carbide flank wear rate achieved by cast D was substantially improved compared with samples from cast E; that crater wear was negligible for samples from cast D tested in both the quenched and tempered and as-forged conditions; that chip form during the carbide tool wear test was excellent for samples from cast D, whereas samples from cast E had poor chip formation that machinability with high speed steel tooling of samples from cast D was at least 24% better than samples from cast E; that chip form of samples from cast D during short drilling trials was superior to that produced from trials on samples from cast E; and that mechanical properties of the samples from cast D met the tensile and impact specification requirements.

We claim:

1. A method of producing a resulphurized steel having a sulphur content of between 0.05% and 0.20% by weight in the form of isolated, globular sulfide inclusions which comprises forming a melt of a steel having between 0.05% and 0.20% by weight of sulphur and adding to the melt an alkali earth metal having a high affinity for sulphur in an amount within the range of about 0.02% and 0.20% by weight to produce in the steel when solidified isolated, globular sulphide inclusions.

2. A method as claimed in claim 1 wherein the sulphur content of the steel lies within the range 0.08 to 0.15% by weight.

3. A method as claimed in claim 1 wherein the sulphur content lies within the range 0.08 to 0.12% by weight.

4. A method as claimed in claim 1 wherein the alkali earth metal comprises calcium or calcium-bearing alloys.

5. A method as claimed in claim 4 wherein the calcium addition lies within the range 0.02 to 0.06% by weight.

6. A method as claimed in claim 4 wherein the calcium addition lies within the range 0.05 and 0.10% by weight.

7. A method as claimed in claim 1 wherein the alkali earth metal is injected into the molten steel through the bore of a hollow lance submerged in the melt.

8. A method as claimed in claim 1 wherein the addition is encapsulated and either thrown or plunged into the ladle containing the melt during teeming.

* * * * *